United States Patent [19]

Tielemans et al.

[11] 4,322,654

[45] Mar. 30, 1982

[54] HIGH-PRESSURE SODIUM VAPOR DISCHARGE LAMP

[75] Inventors: Peter A. W. Tielemans; Cornelis A. J. Jacobs, both of Eindhoven, Netherlands

[73] Assignee: U.S. Philips Corporation, New York, N.Y.

[21] Appl. No.: 75,777

[22] Filed: Sep. 17, 1979

[30] Foreign Application Priority Data

Oct. 6, 1978 [NL] Netherlands ..... 7810088

[51] Int. Cl.[3] ..... H01J 61/073; H01J 61/22

[52] U.S. Cl. ..... 313/218; 313/213; 313/229; 313/346 R

[58] Field of Search ..... 313/218, 229, 346 R, 313/213

[56] References Cited

U.S. PATENT DOCUMENTS 4,052,634 10/1977 De Kok ..... 313/218 X 4,152,620 5/1979 Bhalla ..... 313/218

FOREIGN PATENT DOCUMENTS 714429 8/1954 United Kingdom ..... 313/218

*Primary Examiner*—Palmer C. Demeo

*Attorney, Agent, or Firm*—Robert S. Smith

[57] ABSTRACT

High-pressure sodium vapor discharge lamps are used which contain an electron-emitting material consisting of alkaline earth metal bound to oxygen and tungsten bound to oxygen. It has been found that such lamps which have a high Hg/Na ratio, use neon/argon as a starter gas or have powers of less than 400 W fail prematurely when the alkaline earth metal and tungsten in the electron-emitting material are present in stoichiometric quantities (total alkaline earth metal oxide: $WO_3=3$).

The free ends of electrodes of lamps according to the invention are wound with tungsten wire. Electron-emitting material consisting of strontium bound to oxygen and tungsten bound to oxygen is disposed in the cavities formed between the tungsten wire turns. The molar ratio of the strontium bound to oxygen to the tungsten bound to oxygen is between 3 and 50.

1 Claim, 2 Drawing Figures

HIGH-PRESSURE SODIUM VAPOR DISCHARGE LAMP

Figure 1:
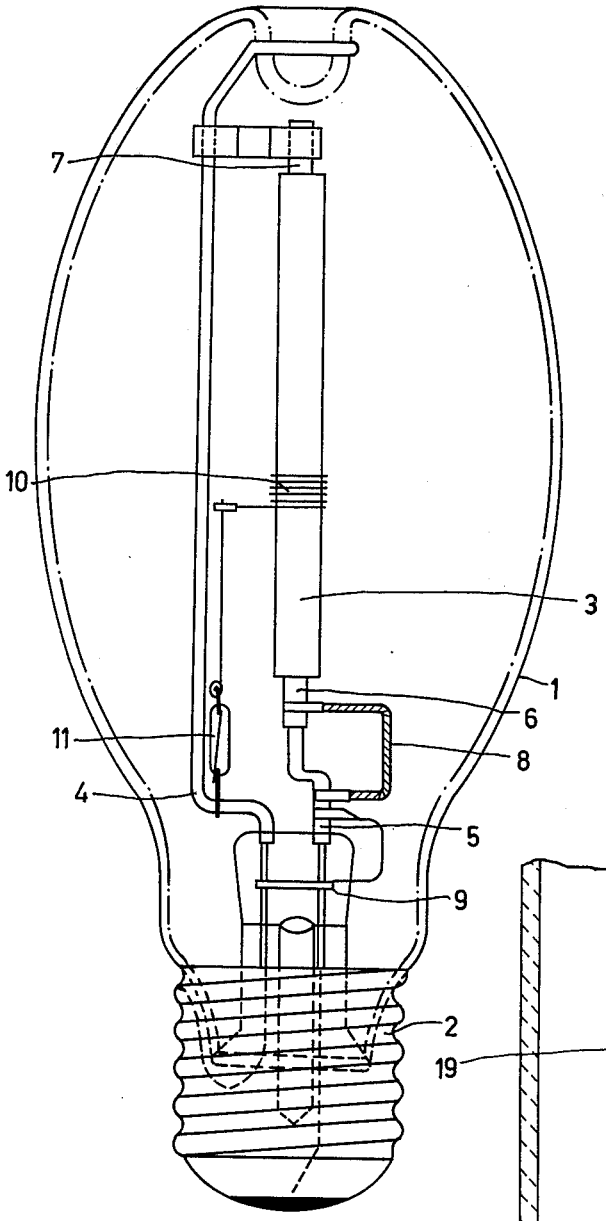

The invention relates to a high-pressure sodium vapor discharge lamp having a heremetically sealed ceramic discharge vessel containing a gas filling comprising sodium, mercury and a rare gas, and lead through the wall of the discharge vessel which extend to respective electrodes disposed in the discharge vessel, which electrodes are wound at their face ends with tungsten wire, the cavities formed between the tungsten wire turns being filled with an electron-emitting material containing alkaline earth metal bound to oxygen and tungsten bound to oxygen. In this lamp the discharge vessel usually consists of polycrystalline or monocrystalline aluminium oxide.

A lamp of this kind is disclosed in U.S. Pat. No. 3,708,710. The electron-emitting material used in this lamp contains BaO, CaO and $WO_3$, preferably in such a ratio that the electron-emitting material consists of $Ba_2CaWO_6$.

It has been found that when this electron-emitting material is used the lamp voltage increases as the number of hours of operation of the lamp increases, to such an extent that the lamp fails at the available line voltage before the electron-emitting material is exhausted. This increase in lamp voltage which is fatal to the lamp, occurs particularly in lamps having mixtures of neon and argon as a starter gas and in lamps having a high mercury: sodium ratio (for example mercury:sodium $\geqq$4/1 wt./wt.). This phenomenon increases the further power of the lamp is below 400 Watts, and also when more than one of the above-mentioned factors play a part in a lamp. It was observed that the lamps which reach the end of their life by reason of an increase of the lamp voltage had a strongly blackened discharge vessel.

It is an object of the invention to provide high-pressure sodium vapor discharge lamps of the kind mentioned in the opening paragraph which have a considerably longer life than known lamps of this kind.

The invention provides a high-pressure sodium vapor discharge lamp having a hermetically sealed ceramic discharge vessel containing a gas filling comprising sodium, mercury and a rare gas, and lead-through conductors which extend through the wall of the discharge vessel to respective electrodes disposed in the discharge vessel, which electrodes are wound at their free ends with tungsten wires, the cavities formed between the tungsten wire turns being filled with electron-emitting material containing oxygen-bound alkaline earth metal and oxygen-bound tungsten, characterized in that the electron-emitting material consists of oxygen-bound strontium and oxygen-bound tungsten in a molar ratio which is between 3:1 and 50:1.

After lamps according to the invention had been in operation for 5000 hours, the lamp voltage had increased by only ten volts and darkening of the discharge vessel was only just discernible. This is a very surprising fact for lamps in which strontium is the only alkaline earth metal in the electro-emitting material. It is generally believed that barium is an essential constituent of the electron-emitting material in order to produce a high emission. In fact, barium has a very low work function. It is considered that calcium would play an important part in electron-emitting materials because calcium oxide has a very low vapor pressure and hence is only evolved very slowly from the electrode. Strontium, however, has a higher work function than barium, while strontium oxide has a higher vapor pressure than calcium oxide. It could therefore by no means be expected that so much better results would be obtained with strontium as the only alkaline earth metal in the electron-emitting material.

The electron-emitting material may be provided on the electrodes in varous manners. For example, the electrodes may be dipped in a suspension of the electron-emitting material in, for example, methanol or n.butyl acetate to which a binder may be added, for example, nitrocellulose.

The electron-emitting material may be prepared on the electrode. In this case the electrode is provided with a suspension of strontium peroxide, strontium hydroxide, strontium carbonate or strontium formate or with another strontium salt which is converted into strontium oxide upon heating. A suspension of a mixture of strontium compounds may also be used. After evaporating the suspension agent, excess material may be removed easily from the electrode. The electrodes are then heated. If oxidizing gases are released, for example, carbon dioxide when carbonates are used, oxidation of the tungsten wire turns present on the electrode occurs, so that oxidized tungsten is incorporated in the electron-emitting material. However, it is alternatively possible for the suspension used to contain tungsten oxide or a tunstate.

The heating of the electrodes, usually at 850° to 1350° C. for ten to a few ten, e.g. 3 to 50 minutes, also produces the adhesion of said electron-emitting material to the electrode in addition to the formation of strontium oxide from other strontium compounds.

Figure 2:
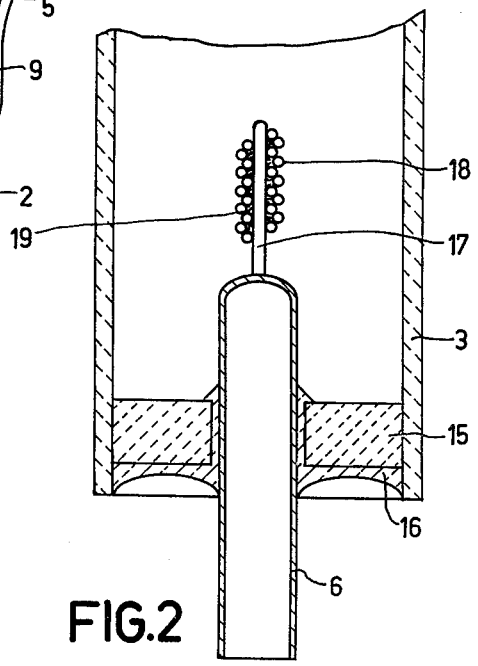

An embodiment of a lamp according to the invention will now be described with reference to the following Example, and to the drawing, in which:

FIG. 1 is a side elevation of a high-presure sodium vapor discharge lamp, and FIG. 2 is a longitudinal sectional view through one end of a lamp vessel of a high-pressure sodium vapor discharge lamp.

In FIG. 1, a discharge vessel 3 is accommodated between current supply conductors 4 and 5 in a glass envelope 1 which has a lamp cap 2.

Niobium sleeves 6 and 7 conduct the current through the wall of the discharge vessel to electrodes (not shown in FIG. 1). A current supply conductor 5 extends in the niobium sleeve 6 with some play. A good electric contact between the sleeve 6 and the conductor 5 is ensured by a stranded wire 8.

A vacuum prevails in the envelope 1 which is maintained by a barium getter evaporated from a ring 9.

A wire 10 is wound around the discharge vessel 3 and is connected to the current conductor 4 via a bimetallic switch 11. The wire 10 is an auxiliary electrode which helps to ignite the lamp. As soon as the switch 11 has become warm due to the operation of the lamp, the electrical connection to the wire 10 is interrupted.

Referring to FIG. 2, the discharge vessel 3 is sealed at its lower end by a ceramic ring 15. The niobium sleeve 6 extends through the ring 15 and is connected thereto by means of a fusible bonding material 16. A tungsten electrode 17 on which a tungsten wire 18 is wound, is welded to the sleeve 6, An electron-emitting material 19 is present in the cavities formed between the turns of wire 18. The construction of the seal at the upper end of the discharge tube 3 is similar to the seal at the lower end.

EXAMPLE

A discharge vessel had an inside diameter of 7.8 mm and an outside length of 103 mm. The distance between the tips of the electrodes was 78 mm. 10 mg of electron-emitting material were provided on each of the electrodes in the cavities of the wire turns. The discharge vessel contained 35 mg of sodium amalgam with a mercury content of 89% by weight, and 20 Torr at room temperature of a starting gas consisting of 99 volumes of neon and 1 volume of argon. During operation the lamp consumed a power of 360 W.

Such lamps having several emitters were tested using a repetitive cycle of 5.5 hours on, 0.5 hours off. It was found that lamps when tested according to this cycle, reached end of life after a smaller number of hours in operation as a result of increase of the lamp voltage than when a cycle of 0.5 hours on, 0.5 hours off was used or when they were continuously in operation.

In a first series of lamps (I) electrodes were used which had been dipped in a suspension of 155 g of $SrCo_3$, 55 ml of ethylglycol, 23 ml of ethylalcohol, 5 ml of butylacetate and 1.5 g of mitrocellulose. After drying the suspension, the electrodes were heated in a vacuum at 1250° C. for 50 minutes.

In a second series of lamps (II) electrodes were used on which the same suspension had been provided. After drying the suspension, the electrodes had been heated in argon at 1800° C. for 3 minutes.

In a third series of lamps (III) electrodes were used which had been dipped in a suspension of 30 g of SrO, 10 ml of butyl acetate and 1 g of polyethylene oxide propylene glycol. After drying the suspension, the electrodes had been heated in a vacuum: 10 minutes at 850° C., 5 minutes at 1060° C., 2 minutes at 1170° C. and 3.5 minutes at 1280° C.

The experimental results are given in the following Table in comparison with results with identical lamps having $Ba_2CaWO_6$ as the emitting material.

TABLE

| | Electron-emitting material | 100 hrs | | 2000 hrs | | 3000 hrs | | 5000 hrs | |
|---|---|---|---|---|---|---|---|---|---|
| | | $\Delta V_{1a}$ | lm/W | $\Delta V_{1a}$ | lm/W % | | lm/W % | $\Delta V_{1a}$ | lm/W % |
| I | $SrO:WO_3$ = 8/1 (mol/mol) | 0 | 97 | +4 | 100 | +2 | 96 | +14 | 92 |
| | | 0 | 97 | −2 | 103 | +6 | 101 | +12 | 94 |
| | | 0 | 97 | +5 | 101 | +3 | 100 | +8 | 95 |
| II | $WO_3$ = 3.6/1 (mol/mol) | 0 | 96 | −2 | 93 | +4 | 92 | | |
| | | 0 | 97 | −4 | 91 | +2 | 87 | | |
| | | 0 | 98 | −3 | 94 | −3 | 93 | | |
| III | $SrO:WO_3$ = 15/1 (mol/mol) | 0 | 97 | −9 | 99 | −8 | 98 | | |
| | | 0 | 98 | −4 | 98 | −3 | 97 | | |
| | | 0 | 95 | −7 | 97 | −6 | 93 | | |
| | $Ba_2CaWO_6$ | 0 | 105 | +26 | 88 | +31 | 86 | + | |
| | | 0 | 95 | +32 | 97 | + | | | |

$V_{1a}$ = variation of the lamp voltage with respect to the lamp voltage after 100 hrs
lm/W % = Lm/W in per cent of the lm/W value after 100 hrs.
+ = lamp failure as a result of a considerable increase of lamp voltage.

What is claimed is:

1. A high-pressure sodium vapor discharge lamp having a hermetically sealed ceramic discharge vessel containing a gas filling comprising sodium, mercury and a rare gas, and lead-through conductors which extend through the wall of the discharge vessel to respective electrodes disposed in the discharge vessel, which electrodes are wound at their free ends with tungsten wires, the cavities formed between the tungsten wire being filled with electron-emitting material consists of oxygen-bound alkaline earth metal and oxygen-bound tungsten, characterized in that the electron-emitting material consists of oxygen-bound strontium and oxygen-bound tungsten in a molar ratio which is between 3:1 and 50:1.

* * * * *